US006235063B1

(12) United States Patent
Nakayama et al.

(10) Patent No.: US 6,235,063 B1
(45) Date of Patent: May 22, 2001

(54) FIBER TREATING COMPOSITION

(75) Inventors: Atsushi Nakayama; Masayuki Komeyama, both of Okayama; Shouji Takekoshi, Shiga; Ichiro Ohsawa; Kenji Nishi, both of Kyoto, all of (JP)

(73) Assignee: Kuraray Co., Ltd., Kurshikishi (JP)

( * ) Notice: Subject to any disclaimer, the term of this patent is extended or adjusted under 35 U.S.C. 154(b) by 0 days.

(21) Appl. No.: 09/317,990

(22) Filed: May 25, 1999

(30) Foreign Application Priority Data

May 25, 1998 (JP) ..... 158633

(51) Int. Cl.[7] ..... D06M 10/00; D06M 10/08; D06M 13/165

(52) U.S. Cl. ..... 8/115.56; 8/115.51; 8/115.6; 8/115.7; 8/116.1; 510/505

(58) Field of Search ..... 8/115.51, 115.6, 8/115.7, 116.1, 115.56; 510/505

(56) References Cited

U.S. PATENT DOCUMENTS 4,619,668 * 10/1986 Frick, Jr. et al. ..... 8/496
5,316,850 * 5/1994 Sargent et al. ..... 428/378
5,766,758 * 6/1998 Hirakawa et al. ..... 428/364
5,840,423 * 11/1998 Sano et al. ..... 438/364

FOREIGN PATENT DOCUMENTS

0801157 * 10/1997 (EP) .

* cited by examiner

*Primary Examiner*—Yogendra Gupta
*Assistant Examiner*—Brian P. Mruk
(74) *Attorney, Agent, or Firm*—Oblon, Spivak, McClelland, Maier & Neustadt, P.C.

(57) ABSTRACT

A composition for crosslinking fibers. The composition displays little foaming, is self-emulsifiable and has good emulsion stability. The composition comprises a compound represented by formula (I) below, and a nonionic surfactant, (I)

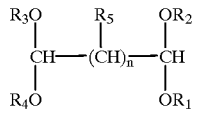

where $R_1$, $R_2$, $R_3$ and $R_4$ each represent an alkyl group; or $R_1$ and $R_2$, and $R_3$ and $R_4$ may form a ring to be an alkylene group; $R_5$ represents a hydrogen atom or an alkyl group; and n represents a number of from 2 to 10. The composition may also contain an anionic surfactant.

16 Claims, No Drawings

FIBER TREATING COMPOSITION

BACKGROUND OF THE INVENTION

1. Field of the Invention

The present invention relates to a fiber treating composition. More precisely, the invention relates to a hardly-foamable and self-emulsifiable, fiber treating composition which can improve the properties of fibers to make them have excellent heat resistance, good steam ironing resistance and good dimension stability, without affecting their excellent sensory feel and dyeability properties.

2. Description of the Related Art

Techniques of treating fibers with crosslinking compounds for the purpose of improving the heat resistance of the fibers are known. For crosslinking fibers, a padding method, a bathing method and others are employed in the art.

In the known methods, crosslinking treatment through padding is generally effected after dyeing. After the crosslinking treatment through padding, however, the fibers are not washed in many cases for the purpose of simplifing the process and of keeping well the appearance and the quality of the processed fibers. Therefore, in such padding treatment for crosslinking, the non-reacted crosslinking compound and the catalyst used often remain in the processed fibers, by which the fastness and other physical properties of the fibers are worsened.

As opposed to this, crosslinking through bathing is advantageous in that it may be effected simultaneously with dyeing. In addition, crosslinking through bathing is generally followed by washing. Therefore, in such bathing treatment for crosslinking, the non-reacted crosslinking compound and the catalyst used could be removed from the processed fibers, and the fastness and other physical-properties of the fibers are prevented from being worsened.

For crosslinking fibers, known is a method of using an aldehyde compound such as dialdehyde or the like as the crosslinking compound to thereby acetalize the hydroxyl groups in fibers.

However, as requiring the specific acetalization step in addition to the dyeing step, the method comprising an acetalization treatment is problematic in terms of process costs. In addition, the method is also problematic in that the processing device is often corroded by the high-concentration strong acid to be used for the acetalization treatment, that dyes could hardly diffuse into the inside of the acetalized fibers and therefore the fibers are difficult to dye thick, and that the dyed fibers are often faded by the non-reacted dialdehyde compound still remaining therein after the acetalization. Because of these problems, the properties of the fibers as processed according to the acetalization method are often not uniform.

In addition, the acetalization on an industrial scale is often accompanied by still other problems in that it is extremely difficult to determine what type of dialdehyde compound shall be used for the acetalization and to determine how the acetalization shall be effected to what degree. Depending on the degree of crosslinking through the acetalization, the color of the dyed fibers often varies, and, as the case may be, the feel of the fibers could not be stabilized. As a result, the commercial value of the processed fibers is often extremely low.

From the viewpoints noted above, it has heretofore been desired to develop a method for crosslinking fibers, which can be attained simultaneously with dyeing the fibers, for which the process and the facilities can be simplified and the costs can be reduced, in which the feel and the physical properties of the fibers processed are prevented from being worsened, and in which the fibers being treated are well crosslinked while being dyed to have a uniform and sharp color tone, and to develop crosslinking compounds for the method and also a fiber treating composition that contains the compound.

Given that situation, EP 0801157A2 describes a technique of crosslinking ethylene-vinyl alcohol copolymer fibers with a compound of a general formula (I):

(I)

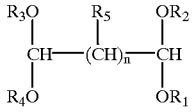

wherein $R_1$, $R_2$, $R_3$ and $R_4$ each represent an alkyl group; or $R_1$ and $R_2$, and $R_3$ and $R_4$ may form a ring to be an alkylene group; $R_5$ represents a hydrogen atom or an alkyl group; and n represents a number of from 2 to 10, under a specific condition to thereby improve the heat resistance, the steam ironing resistance, the dimension stability and other physical properties of the resulting crosslinked fibers.

However, there remains a need for improved fiber treatment compositions.

SUMMARY OF THE INVENTION

It is an object of the present invention to provide compositions for treating fibers which have improved properties as compared to known compositions.

It is another object of the present invention to provide methods of making these fiber treating compositions.

It is yet another object of the present invention to provide methods of treating fibers with such compositions, especially methods for crosslinking fibers.

The present invention is based, in part, on the discovery that the compounds of formula (I), when combined with nonionic surfactants, can be stably emulsified in a treating bath.

In particular, it has been discovered that, when a fiber treating composition that comprises a compound (I), a nonionic surfactant and an anionic surfactant is used in a fiber treating process, it develops extremely excellent emulsifiability within a broad temperature range between a relatively low temperature of room temperature or so and a high temperature above 100° C. that may be the temperature for fiber crosslinking reaction, and foams little, that the crosslinking of fibers with the composition can be attained in the same bath as that for dyeing the fibers, and that the heat resistance, the steam ironing resistance and the dimension stability of the fibers as crosslinked with the composition are significantly improved with the resulting fibers still keeping the good feel, the uniform dyeability and the deep dyeability of the original fibers.

Accordingly, the objects of the present invention, and others, may be accomplished with fiber treating composition that comprises:

(a) a compound of the following general formula (I) (this is hereinafter referred to as compound (I)):

(I)

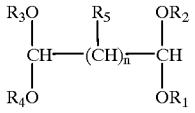

wherein $R_1$, $R_2$, $R_3$ and $R_4$ each, independently, represent an alkyl group;

or $R_1$ and $R_2$, and $R_3$ and $R_4$ may form a ring to be an alkylene group;

$R_5$ represents a hydrogen atom or an alkyl group; and n represents a number of from 2 to 10, and (b) a nonionic surfactant.

In a preferred embodiment of the present invention, the composition also contains (c) an anionic surfactant.

The objects of the invention may also be accomplished with a process of making the compositions by combining (a), (b) and, if present, (c).

The objects of the invention may also be accomplished with a method of treating fibers by contacting the fibers with the compositions described above.

The objects of the invention may also be accomplished with a method of crosslinking fibers by contacting the fibers with the compositions described above.

A more complete appreciation of the invention and many of the attendant advantages thereof will be readily obtained as the same becomes better understood by reference to the following detailed description when considered in connection with the accompanying drawings, wherein:

DETAILED DESCRIPTION OF THE INVENTION

The fiber treating composition of the present invention for obtaining crosslinked fibers contains a compound (I) which is represented by the following general formula (I):

(I)

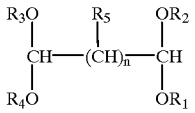

where $R_1$, $R_2$, $R_3$, $R_4$, $R_5$, and n are as defined above.

In formula (I), the alkyl group for $R_1$ to $R_4$ is preferably an alkyl group having from 1 to 4 carbon atoms. Especially preferred is a methyl group in view of the easiness in handling the compounds (I). If desired, the alkyl group may be substituted with an alkyleneoxy groups such as an ethyleneoxy group or the like. All $R_1$ to $R_4$ may be alkyl groups of the same type, or they may differ, i.e., $R_1$ to $R_4$ are independently selected.

Where $R_1$ and $R_2$, and/or $R_3$ and $R_4$ are bonded to each other to form a ring of an alkylene group, the alkylene group preferably has from 1 to 4 carbon atoms. In view of the stability of the cyclic structure, it is desirable that the alkylene group is of a 5-membered or 6-membered ring. Therefore, preferred is an ethylene or propylene group having 2 or 3 carbon atoms. The alkyl group and the alkylene group may have substituents, such as, for example, as described above for $R_1$ to $R_4$.

In formula (I), n is not limited to integers, and shall be calculated in accordance with the compositional ratio of a plurality of compounds (I), if used together. In other words, the composition may contain two or more different compounds each represented by formula (I).

Since the composition may be used for crosslinking fibers, it is preferable that compounds (I) do not have a branched chain. For this, $R_5$ is preferably a hydrogen atom. Compounds (I) may be in the form of a mixture of branched compounds (I) where $R_5$ is an alkyl group having from 1 to 4 carbon atoms and non-branched compounds (I) where $R_5$ is a hydrogen atom. However, in order to obtain fibers with better heat resistance, preferably used are non-branched compounds (I) only or a mixture of branched compounds (I) and non-branched compounds (I) in which the proportion of the non-branched compounds (I) is larger.

In compounds (I), plural $R_5$'s, of which the number is represented by "n", may be all the same, for example, they are all hydrogen atoms; or may be in the form of a mixture of alkyl groups and hydrogen atoms, of which the total number is "n". Of those plural $R_5$'s, the alkyl groups may be all of the same type or may be in the form of a mixture of different types of alkyl groups.

In compounds (I), n is a number of from 2 to 10. The fiber treating composition of the invention may comprise only one type of compound (I) where n is the same, or may comprise a mixture of different types of compounds (I) where n differs. In the latter case where a mixture of different types of compounds (I) with n differing therein is used, the average number of those different n's in the mixture shall fall between 2 and 10. In the invention, it is desirable that the value of n in compounds (I) (for the mixture of compounds (I), this shall be the average number of different n's) falls between 5 and 9 in view of the feel of the crosslinked fiber products. The range for n includes all specific values and subranges therebetween, such as 3, 4, 5, 6, 7, 8 and 9.

Preferred examples of compounds (I) include 1,1,6,6-tetramethoxyhexane, 1,1,6,6-tetraethoxyhexane, 1,1,7,7-tetramethoxyheptane, 1,1,7,7-tetraethoxyheptane, 1,1,8,8-tetramethoxyoctane, 1,1,8,8-tetraethoxyoctane, 1,1,9,9-tetramethoxyndnane, 1,1,9,9-tetraethoxynonane, 1,1,9,9-bisethylenedioxynonane, 1,1,9,9-bispropylenedioxynonane, 1,1,10,10-tetramethoxydecane, 1,1,10,10-tetraethoxydecane, 1,1,11,11-tetramethoxyundecane, 1,1,11,11 1 -tetraethoxyundecane, etc. One or more of these compounds can be used either singly or as combined, of those, preferred are 1,1,9,9-tetraalkoxynonanes such as 1,1,9,9-tetraethoxynonane, etc., and 1,1,9,9-bisalkylenedioxynonanes such as 1,1,9,9-bisethylenedioxynonane, 1,1,9,9-bispropylenedioxynonane, etc., in view of the feel of the crosslinked fibers. Especially preferred is 1,1,9,9-bisethylenedioxynonane.

As being blocked with alkyl groups and/or cyclic structures at their both terminals, compounds (I) are extremely stable and are not oxidized even when contacted with oxygen in air. When processed with a weak acid at a high temperature under high pressure, compounds (I) are deacetalized at the both terminals; and when reactive groups (e.g., hydroxyl group, etc.) in fibers exist around the compound (I) being deacetalized in that condition, the reactive groups in those fibers react with the compound (I) through acetalization (crosslinking).

Being different from this reaction, the conventional crosslinking reaction in fibers is effected with a strong acid such as sulfuric acid or the like in a strong acidic condition of generally 1 or 2 normalities (for example, as in JP-A 3-114015). As compared with the conventional crosslinking reaction to be effected under such a strong acidic condition, the crosslinking reaction in fibers with compounds (I) in the invention improves more the characteristics such as the heat resistance, the steam ironing resistance, the dimension stability and the dyeability of the fibers without worsening the feel and even the physical properties of the fibers.

For smoothly cross linking fibers in a treating bath that contains a compound (I), it is especially preferred that the compound (I) stably exists in the bath while being dissolved or uniformly dispersed therein all the time from the initial stage of the reaction to the final stage thereof.

The fiber treating composition of the invention comprises a compound (I) and a nonionic surfactant, preferably containing an anionic surfactant in addition to them, and this is self-emulsifiable. When the composition is added to a treating bath and when fibers are treated in the bath, the compound (I) can be stably emulsified and dispersed in the bath all the time from the initial stage of the treatment to the final stage thereof within a broad temperature range covering low temperatures and high temperatures. Therefore, using the fiber treating composition of the invention ensures uniform and smooth crosslinking of fibers with the compound (I).

In the invention, the fiber treating composition comprises a compound (I) along with a nonionic surfactant or along with a combination of a nonionic surfactant and an anionic surfactant. Therefore, the emulsion stability of the composition in a treating bath is good. In an acidic treating bath that contains the composition, fibers can be crosslinked with the compound (I) at high temperatures. In particular, when the composition comprising the compound (I) contains both a nonionic surfactant and an anionic surfactant, its emulsion stability in the treating bath is much better all the time from the initial stage of the fiber treatment in the bath to the final stage thereof, and therefore the fibers being treated are crosslinked much more smoothly.

Where the substance to be subjected to crosslinking treatment according to the invention is in the form of fabric, preferably employed is a method of crosslinking the fibers constituting the fabric while the fabric is continuously run through a jet-processing apparatus (jet-dyeing apparatus), or a method of crosslinking the fibers constituting the fabric while the fabric is dyed at the same time, in view of the productivity and of the easiness in the operation.

In that case, if the treating bath foams too much, smooth running of the fabric in the bath will be impossible, whereby the process will be interrupted and the productivity will be lowered. In addition, too much foaming of the bath will interfere with uniform and rapid penetration and adhesion of the compound (I) into and onto the fabric being processed in the bath, and will even interfere with uniform and rapid penetration and adhesion of the dye into and onto the fabric when the bath contains a dye along with the compound (I). As a result of the bath foaming, the productivity in crosslinking reaction in the fibers will be lowered, the fibers will be crosslinked unevenly and will be dyed also unevenly and even insufficiently, and the physical properties of the treated fibers will be worsened. Not limited to the case of treating fabric in such a jet-processing apparatus (jet-dyeing apparatus), the same shall apply also to other cases of treating various fibrous materials including fluffy fibers, yarns, filaments, clothes and other fibrous products. Anyhow, if the treating liquid that contains a compound (I) foams too much, the productivity in crosslinking fibrous materials with the compound (I) will be lowered, fibrous materials will be crosslinked unevenly with the compound (I) and will be dyed also unevenly and even insufficiently, and the physical properties of the fibrous materials treated will be worsened.

For the purpose of preventing the bath foaming that causes the disadvantages noted above, it is desirable that the fiber treating composition contains at least a nonionic surfactant along with the compound (I). From the total viewpoint of the emulsion stability of the composition, the ability of the composition to prevent the bath foaming, the processability of fibrous materials with the composition, and the physical properties and the quality of the fibrous materials as crosslinked with the composition or as crosslinked with it while being dyed, it is more desirable that the fiber treating composition of the invention contains both a nonionic surfactant and an anionic surfactant along with the compound (I).

In the present invention, the nonionic surfactant to be used may be any known one. Specific examples of the nonionic surfactant usable herein include polyoxyalkylene-alkylphenyl ethers, polyoxyalkylene-tristyrylphenyl ethers, polyoxyalkylene-alkyl ethers, polyoxyalkylene-alkyl esters, castor oil-alkyleneoxide adducts, partial esters of fatty acids with polyalcohols, partial esters of fatty acids with polyoxyalkylene-polyalcohols, esters of fatty acids with polyglycerins, polyoxyalkylene-alkylamines, fatty acid diethanolamides, partial esters of triethanolamine-fatty acids, etc. One or more of these nonionic surfactants may be used along with the compound (I).

Of the nonionic surfactants, preferred for use in the invention are castor oil-alkyleneoxide adducts, partial esters of fatty acids with polyoxyalkylene-polyalcohols, and polyoxyalkylene-tristyrylphenyl ethers, as these are more effective for improving the emulsifiability of compounds (I), for retarding the bath foaming and for improving the dyeability of the fibers as processed with the composition.

Where crosslinking of fibers is effected in the presence of a nonionic surfactant having a polyoxyalkylene skeleton at high temperatures higher than 100° C., the fibers will be often colored. In that case, the coloring could be prevented by the use of a chelating agent, such as sodium ethylenediaminetetraacetate, diethylenetriamine, sodium iminodiacetate or the like.

The anionic surfactant for use in the invention may be any known one. Specific examples of anionic surfactants usable herein include alkylsulfates, alkylsulfonates, alkylarylsulfates (alkylbenzenesulfates, alkylnaphthalenesulfates, etc.), alkylarylsulfonates (alkylbenzenesulfonates, alkylnaphthalenesulfonates, etc.), polyoxyalkylene-alkyl ether sulfates, polyoxyalkylenetristyrylphenyl ether sulfates, polyoxyalkylene-alkyl ether phosphates. polyoxyalkylene-alkyl ether carboxylates, polycarboxylates, Turkey red oil, petroleum sulfonates, polystyrenesulfonates, alkyldiphenyl ether disulfonates, alkyl acid phosphates, etc. One or more of these anionic surfactants can be used along with the nonionic surfactant noted above.

Of the anionic surfactants, preferred for use in the invention are alkylarylsulfonates and/or polyoxyalkylene-tristyrylphenyl ether sulfates, in view of their ability to emulsify the compounds (I) and to disperse dyes.

The anionic surfactants mentioned above may be in any form of alkali metal salts, alkaline earth metal salts, ammonium salts, organic amine salts or others.

The amount of the compound (I) to be in the fiber treating composition of the invention is not particularly limited. Preferably, however, the composition contains the compound (I) in a ratio of from 5 to 95% by weight based on the weight of the composition, in view of the emulsion stability of the composition and the storage stability thereof, and of the smooth and efficient crosslinking reaction in fibers. More preferably, the composition contains the compound (I) in a ratio of from 10 to 90% by weight, even more preferably from 50 to 90% by weight. These weight % ranges for (I)

include all specific values and subranges therebetween, including 8, 15, 20, 25, 30, 40, 60, 70, 80 and 85% by weight.

In the fiber treating composition of the invention, a larger amount of the nonionic surfactant enhances more the emulsion stability of the compound (I) therein, and enhances more the uniform dyeability of fibers when the composition contains a dye. However, if the amount of the nonionic surfactant in the composition is too large, the dyeing speed of fibers will be lowered. Therefore, it is desirable that the amount of the nonionic surfactant in the -composition is from 2 to 30% by weight based on the weight of the composition, more preferably from 10 to 25% by weight. These weight ranges include all specific values and subranges therebetween, including 5, 8, 12, 15 and 25% by weight.

In the fiber treating composition of the invention, a larger amount of the anionic surfactant enhances more the emulsion stability of the compound (I) therein, and enhances more the dispersibility of a dye, if any, in the composition. However, If the amount of the anionic surfactant in the composition is too large, the composition will foam much, thereby resulting in that smooth crosslinking of fibers and even smooth dyeing of fibers will be difficult and, in addition, smooth running of fabric in a bath will be retarded. Therefore, it is desirable that the amount of the anionic surfactant in the composition falls between 2 and 20% by weight based on the weight of the composition, more preferably between 2 and 10% by weight. These weight ranges include all specific values and subranges therebetween, including 3, 5, 8, 12 and 15% by weight.

Where the fiber treating composition of the invention contains both a nonionic surfactant and an anionic surfactant along with a compound (I), it is desirable that the amount of the nonionic surfactant in the composition falls between 2 and 30 parts by weight and that of the anionic surfactant therein falls between 2 and 20 parts by weight, based on 100 parts by weight of the compound (I), in view of the emulsion stability of the compound (I) in the composition and the capabilities of the surfactants to prevent the composition from foaming, and even in view of the dispersion stability of the dye, if any, in the composition, the uniform dyeability of fibers with the dye and the good fixability of the dye to fibers.

In particular, the fiber treating composition comprising a compound (I), and containing at least one of castor oil-alkyleneoxide adducts, partial esters of fatty acids with polyoxyalkylene-polyalcohols, and polyoxyalkylene-tristyrylphenyl ethers, as the nonionic surfactant, and an alkylarylsulfonate and/or a polyoxyalkylene-tristyrylphenyl ether sulfate, as the anionic surfactant, where both the proportion of the nonionic surfactant and that of the anionic surfactant to the compound (I) fall within the ranges defined as above, is preferred, in view of the good emulsion stability of the compound (I) in the composition, the good capabilities of the surfactants to prevent the composition from foaming, the good dispersion stability of a dye, if any, in the composition, the uniform dyeability of fibers with the dye, and the good fixability of the dye to fibers.

The fiber treating composition of the invention may be comprised of a compound (I) and above-mentioned surfactant only, but may additionally contain, if desired, a small amount of other components, such as water, an organic solvent, etc. In particular, it is preferable to add an organic solvent to the composition, since the organic solvent, if any, in the composition could further improve the emulsion stability of the compound (I) in the composition.

Typical examples of the organic solvent that may be in the fiber treating composition of the invention include methyl alcohol, ethyl alcohol, isopropyl alcohol, benzene, xylene, toluene, ethyl acetate, dimethylformamide, petroleum ether, chloroform, ethylene glycol, butyl cellosolve, 1,5-pentanediol, ethylene carbonate, propylene carbonate, propylene glycol, dipropylene glycol, triethylene glycol, triethylene glycol dimethyl ether, pentaethylene glycol monobutyl ether, diethylene glycol monomethyl ether, tetraethylene glycol dimethyl ether, propylene glycol monomethyl ether, dipropylene glycol monomethyl ether, etc. One or more of these organic solvents may be used herein. Of those, preferred are/is ethylene glycol and/or butyl cellosolve, in view of the emulsion stability of the compound (I) in the composition.

The amount of the organic solvent in the fiber treating composition is preferably at most 30% by weight based on the weight of the composition, more preferably from 2 to 20% by weight. These weight % ranges include all specific values and subranges therebetween, such as 5, 10, 15 and 25% by weight.

The fiber treating composition of the invention is preferably used for crosslinking fibers having reactive groups such as hydroxyl groups, carboxyl groups, amido groups, etc. Examples of such fibers include those having hydroxyl groups of cotton, hemp, rayon, cupra, polynosic, lyocell, as well as polyvinyl alcohol fibers, ethylene-vinyl alcohol copolymer fibers, etc.; protein fibers of wool, silk, etc.; composite fibers and mixed spun fibers that comprise, as the partial segments, polymers having reactive groups such as hydroxyl groups and the like such as polyvinyl alcohol, ethylene-vinyl alcohol copolymers, etc. Above all, the fiber treating composition of the invention is especially suitable to crosslinking treatment of fibers having hydroxyl groups or to that of composite fibers or mixed spun fibers comprising, as one component, a polymer having hydroxyl groups.

The fibers to be crosslinked with the fiber treating composition of the invention may be in any form of, for example, fluffy fibers, yarns, filaments, staple fibers, slivers, hank, fabrics, nets, clothes and any other fibrous products.

For crosslinking fibers with the fiber treating composition of the invention, employable are any known methods of bathing, padding, spraying, air jet-processing, etc. Of those, a bathing method is preferred. This is because, in the bathing method, washing the crosslinked fibers is easy to remove the non-reacted crosslinking compound and the catalyst used from the fibers, and therefore, the fastness and other physical properties of the fibers are prevented from being worsened; crosslinking fibers with the compound (I) and dyeing them can be affected in one and the same bath, and therefore the process and even the facilities for the method could be simplified, and the productivity of the method is high; and fibers can be uniformly crosslinked.

To crosslink fibers with the fiber treating composition of the invention, it is desirable that the composition is added to a liquid medium such as water, a mixture of water/organic solvent or the like to prepare an emulsion, and the resulting emulsion is used for the treatment of fibers. In preparing the emulsion for fiber treatment, the amount of the fiber treating composition to be added to the medium is not specifically defined, and may be controlled in any desired manner, depending on the type and the form of the fibers to be treated, on the type of the medium to be used, and on the condition of the composition. In general, however, the fiber treating composition of the invention may be added to a liquid medium of water, a mixture of water/organic solvent or the like, in an amount of from 1 to 40 g or so of the composition relative to one liter of the liquid medium to prepare an emulsion, and the resulting emulsion may be used for treating fibers.

In treating fibers with the emulsion, the emulsion is kept weakly acidic, having a pH of from 2 to 4 or so, and heated at a temperature falling between 80 and 130° C. In that manner, the fibers can be smoothly crosslinked, or can be smoothly crosslinked while being dyed.

EXAMPLES

The invention is described more concretely with reference to the following Examples, which, however, are not intended to restrict the scope of the invention. In the following Examples and Comparative Examples, parts are by weight unless otherwise specifically indicated.

In the following Examples and Comparative Examples, the emulsification test, the foaming test, the dyeing test (for level dyeing and dye fixation), the feel test and the heat resistance test were made according to the following methods.

Emulsification Test:

(1) 10 g of a fiber treating composition to be tested of the following Examples and Comparative Examples is added to one liter of distilled water, along with maleic acid thereto, to prepare a weakly acidic emulsion having a pH of from 2.3 to 2.4. The condition of the resulting emulsion is visually observed, and the emulsifiability of the composition is evaluated according to the criteria shown in Table 1 below.

(2) 200 ml of the emulsion as prepared in (1) is put into a beaker, heated in a water bath, and kept at 60° C. therein for 5 minutes. The condition of the thus-heated emulsion is visually observed, and the emulsifiability of the composition is evaluated according to the criteria shown in Table 1 below.

(3) After the test of (2), the emulsion is firter heated, and kept at 100° C. for 5 minutes. The condition of the thus-heated emulsion is visually observed, and the emulsifiability of the composition is evaluated according to the criteria shown in Table 1 below.

TABLE 1

| Criteria for Evaluation of Emulsifiability | |
|---|---|
| Excellent | The compound (I) was extremely finely emulsified and dispersed in the liquid, and the liquid was milky white. |
| Good | The compound (I) was emulsified and dispersed as liquid drops in the liquid. |
| Bad | The phase of the compound (I) was separated to form a layer in the upper part of the liquid, and was not emulsified. |

Foaming Test:

(1) 10 g of a fiber treating composition to be tested of the following Examples and Comparative Examples is added to one liter of distilled water, along with maleic acid thereto, to prepare a weakly acidic emulsion having a pH of from 2.3 to 2.4.

(2) 1500 ml of the emulsion as prepared in (1) is fed into a jet-dyeing machine (Warner Mathis AG's Model JFL), and circulated therein at predetermined temperatures (30° C., 50° C., 70° C., 900 C., and 115° C.). The height of the foam of the emulsion as seen through the window of the machine is measured, which indicates the foamability of the composition.

Dyeing Test (for level dyeing and dye fixation):

(1) In the manner as described in the following Examples or Comparative Examples, a crosslinking and/or dyeing liquid (hereinafter referred to as "processing liquid") that comprises a fiber treating composition to be tested of the following Examples or Comparative Examples is prepared.

(2) A satin crepe fabric (scoured) is prepared, in which the warp and the weft are both of sheath-core composite fibers (core/sheath=50/50 by weight; 50 deniers/24 filaments) with the sheath component being an ethylene-vinyl alcohol copolymer (having an ethylene content of 32 mol %, and a degree of hydrolysis of 99%) and with the core component being a polyethylene terephthalate as copolymerized with 10 mol % of isophthalic acid.

(3) 200 ml of the processing liquid as prepared in (1) is put into the bath of a closed dyeing machine (from TEXAM), and 10 g of the fabric as prepared in (2) is put thereinto (bath ratio, 1:20). Then, the bath is heated from 70° C. up to 115° C. at a heating rate of 1° C./min, kept at the elevated temperature for 40 minutes to complete the crosslinking and/or dyeing treatment. Next, the thus-processed fabric is taken out of the bath, then fully rinsed with water, and thereafter left in air to be spontaneously dried.

(4) The fabric as obtained in (3) is visually observed to check its color condition. Samples as uniformly dyed with no color spots are evaluated "excellent"; those as nearly uniformly dyed with a few color spots are evaluated "good"; and those with many color spots are evaluated "bad".

(5) The processing liquid still remained in the bath, from which the dyed fabric has been taken out in (3), is collected, and its absorbance (A1) is measured. The ratio of A1/A0, in which A0 indicates the absorbance of the original processing liquid before treatment, is obtained. According to the criteria shown in Table 2 below, the degree of exhaustion of the dye used is obtained, which indicates the degree of fixation of the dye to the fabric. In this test, the smaller ratio A1/A0 means that the fabric was dyed better with the dye (that is, the fixability of the dye to the fibers constituting the fabric is higher).

TABLE 2

| Criteria for Evaluation of Dye Fixability | |
|---|---|
| $A1/A0 < 0.1$ | Excellent |
| $0.1 \leqq A1/A0 < 0.2$ | Good |
| $0.2 \leqq A1/A0 < 0.3$ | Average |
| $A1/A0 \geqq 0.3$ | Bad |

Feel of Fabric:

The feel of the dry fabric having been crosslinked and dyed in (3) in the dyeing test noted above is tested for its touch to the hand. Samples with good and soft touch are evaluated "good"; and those with hard touch are evaluated "bad".

Heat Resistance Test:

The dry fabric having been crosslinked and dyed in (3) in the dyeing test is sprayed with steam at 120° C. for 30 seconds, and the degree of shrinkage of the sprayed fabric is measured. Samples having a degree of shrinkage of not larger than 3% are evaluated "good"; and those having a degree of shrinkage of larger than 3% or having been wrinkled are evaluated "bad".

Example 1

(1) The components shown in Table 3 below were mixed in the ratio shown therein to prepare a fiber treating composition.

TABLE 3

| | |
|---|---|
| 1,1,9,9-Bisethylenedioxynonane (BEN) | 80 parts |
| Ammonium laurylsulfonate (from Meisei Chemical) | 2 parts |
| Sodium dodecylbenzenesulfonate (from Meisei Chemical) | 2 parts |
| Castor oil-ethyleneoxide adduct (from Meisei Chemical) | 7 parts |
| Polyoxyethylene-propylene octyl ether (from Meisei Chemical) | 3 parts |
| Ethylene glycol | 6 parts |
| Total | 100 parts |

(2) The fiber treating composition as prepared in (1) was subjected to the emulsification test and the foaming test according to the methods mentioned above. The data obtained are shown in Table 6 below.

(3) A dyeing liquid was prepared, which comprised 12.0% (owf) of the fiber treating composition of (1), 1.0 g/liter of maleic acid, and dyes, Dianix Yellow AC-E (from Dyster Japan), Dianix Blue AC-E (from the same) and Dianix Red AC-E (from the same) with each dye being 0.3% owf. The dyeing liquid was subjected to the dyeing test (for level dyeing and dye fixation) according to the method mentioned above. The feel and the heat resistance of the dyed fabrics were tested also according to the methods mentioned above. The data obtained are shown in Table 6 below.

Example 2

(1) The components shown in Table 4 below were mixed in the ratio shown therein to prepare a fiber treating composition

TABLE 4

| | |
|---|---|
| 1,1,9,9-Bisethylenedioxynonane (BEN) | 65 parts |
| Sodium polyoxyethylene-lauryl ether sulfate (from Meisei Chemical) | 8 parts |
| Polyoxyethylene-tristyrylphenyl ether (from Meisei Chemical) | 12 parts |
| Polyoxyethylene-myristylphenyl ether (from Meisei Chemical) | 5 parts |
| Butyl cellosolve | 10 parts |
| Total | 100 parts |

(2) The fiber treating composition as prepared in (1) was subjected to the emulsification test and the foaming test according to the methods mentioned above. The data obtained are shown in Table 6 below.

(3) A dyeing liquid was prepared, which comprised 18.0% (owf) of the fiber treating composition of (1), 1.0 g/liter of maleic acid, and the same dyes as in Example 1 with each dye being 0.3% owf. The dyeing liquid was subjected to the dyeing test (for level dyeing and dye fixation) according to the method mentioned above. The feel and the heat resistance of the dyed fabrics were tested also according to the methods mentioned above. The data obtained are shown in Table 6 below.

Example 3

(1) 10 parts of 1,1,9,9-bisethylenedioxynonane (BEN) and 90 parts of castor oil-ethyleneoxide adduct (from Meisei Chemical) were mixed at room temperature to prepare a fiber treating composition.

(2) The fiber treating composition as prepared in (1) was subjected to the emulsification test and the foaming test according to the methods mentioned above. The data obtained are shown in Table 6 below.

(3) A dyeing liquid was prepared, which comprised 100% (owf) of the fiber treating composition of (1), 1.0 g/liter of maleic acid, and the same dyes as in Example 1 with each dye being 0.3% owf. The dyeing liquid was subjected to the dyeing test (for level dyeing and dye fixation) according to the method mentioned above. The feel and the heat resistance of the dyed fabrics were tested also according to the methods mentioned above. The data obtained are shown in Table 6 below.

Example 4

(1) The components shown in Table 5 below were mixed in the ratio show therein to prepare a fiber treating composition.

TABLE 5

| | |
|---|---|
| 1,1,9,9-Bisethylenedioxynonane (BEN) | 75 parts |
| Polyoxyethylene-tristyrylphenyl ether sulfate amine salt (from Meisei Chemical) | 2.4 parts |
| Castor oil-ethyleneoxide adduct (from Meisei Chemical) | 10 parts |
| Polyoxyethylene-higher alcohol ether (from Meisei Chemical) | 6 parts |
| Butyl cellosolve | 5.6 parts |
| Water | 1 part |
| Total | 100 parts |

(2) The fiber treating composition as prepared in (1) was subjected to the emulsification test and the foaming test according to the methods mentioned above. The data obtained are shown in Table 6 below.

(3) A dyeing liquid was prepared, which comprised 15% (owf) of the fiber treating composition of (1), 1 giliter of maleic acid, and the same dyes as in Example 1 with each dye being 0.3% owf. The dyeing liquid was subjected to the dyeing test (for level dyeing and dye fixation) according to the method mentioned above. The feel and the heat resistance of the dyed fabrics were tested also according to the methods mentioned above. The data obtained are shown in Table 6 below.

Comparative Example 1

(1) 10 parts of 1,1,9,9-bisethylenedioxynonane (BEN) was mixed with 90 parts of an organic solvent (methanol, isopropyl alcohol, ethylene glycol, butyl cellosolve, chloroform or propylene carbonate), but BEN did not dissolve in any of those solvents and formed a separate phase in the mixtures. Therefore, in the emulsification test, all the compositions prepared in this Comparative Example 1 were evaluated "bad" as in Table 6 below.

(2) In the compositions of this Comparative Example 1, BEN was neither dissolved nor emulsified in the organic solvents used. In other words, neither solution nor emulsion was prepared herein. Therefore, the dyeing test, the feel test and the heat resistance test were not made for the compositions.

Comparative Example 2

(1) 5 parts of 1,1,9,9-bisethylenedioxynonane (BEN) was mixed with 95 parts of distilled water, but BEN did not dissolve in the water and formed a separate phase in the mixture. Therefore, in the emulsification test, the composition prepared in this Comparative Example 2 was evaluated "bad" as in Table 6 below.

(2) In the composition of this Comparative Example 2, BEN was neither dissolved nor emulsified in water. In other words, neither aqueous solution nor emulsion was prepared herein. Therefore, the dyeing test, the feel test and the heat resistance test were not made for the composition.

Comparative Example 3

(1) 10 parts of 1,1,9,9-bisethylenedioxynonane (BEN) was mixed with 10 parts of distilled water and 80 parts of an organic solvent (methanol, isopropyl alcohol, ethylene glycol, butyl cellosolve, chloroform or propylene carbonate), but BEN did not dissolve in any of those mixed solvents with water and formed a separate phase in the mixtures. Therefore, in the emulsification test, all the compositions prepared in this Comparative Example 3 were evaluated "bad" as in Table 6 below.

(2) In the compositions of this Comparative Example 3, BEN was neither dissolved nor emulsified in the any of the mixed solvents of water/organic solvent. In other words, neither solution nor emulsion was prepared herein. Therefore, the dyeing test, the feel test and the heat resistance test were not made for the compositions.

Comparative Example 4

(1) 80 parts of 1,1,9,9-bisethylenedioxynonane (BEN) and 20 parts of sodium dodecylbenzenesulfonate (from Meisei Chemical) were mixed at room temperature to prepare a fiber treating composition.

(2) The fiber treating composition as prepared in (1) was subjected to the emulsification test and the foaming test according to the methods mentioned above. The data obtained are shown in Table 6 below.

(3) A dyeing liquid was prepared, which comprised 18.0% (owf) of the fiber treating composition of (1), 1.0 g/liter of maleic acid, and the same dyes as in Example 1 with each dye being 0.3% owf. The dyeing liquid was subjected to the dyeing test (for level dyeing and dye fixation) according to the method mentioned above. The feel and the heat resistance of the dyed fabrics were tested also according to the methods mentioned above. The data obtained are shown in Table 6 below.

TABLE 6

| | Example 1 | Example 2 | Example 3 | Example 4 | Comparative Example 1 | Comparative Example 2 | Comparative Example 3 | Comparative Example 4 |
|---|---|---|---|---|---|---|---|---|
| Fiber Treating Composition | | | | | | | | |
| Compound (I) (wt. pts.) | BEN (80) | BEN (65) | BEN (10) | BEN (75) | BEN (10) | BEN (5) | BEN (10) | BEN (80) |
| Nonionic surfactant (wt. pts.) | a1 (7)<br>a2 (3) | a3 (12)<br>a4 (5) | a1 (90) | a1 (10)<br>a5 (6) | | | | |
| Anionic surfactant (wt. pts.) | b1 (2)<br>b2 (2) | b3 (8) | | b4 (2.4) | | | | b2 (20) |
| Solvent (wt. pts.) | c1 (6) | c2 (10) | | c2 (5.6)<br>water (1) | c1 to c6 (90) | water (95) | c1 to c6 (80)<br>water (10) | |
| Total | 100 | 100 | 100 | 100 | 100 | 100 | 100 | 100 |
| Emulsification test | | | | | | | | |
| initial state (at room temp.) | excellent | excellent | good | excellent | bad | bad | bad | somewhat bad |
| after 5 minutes at 60° C. | excellent | excellent | good | excellent | bad | bad | bad | good |
| after 5 minutes at 100° C. | excellent | excellent | good | excellent | bad | bad | bad | good |
| Foaming test | 120 | 120 | 150 | 125 | — | — | — | 180 |
| 30° C. | 120 | 130 | 150 | 140 | — | — | — | 240 |
| 50° C. | 120 | 140 | 150 | 140 | — | — | — | 240 |
| 70° C. | 120 | 140 | 150 | 140 | — | — | — | 240 |
| 90° C. | 110 | 130 | 120 | 180 | — | — | — | 240 |
| 115° C. | 110 | 115 | 125 | 180 | — | — | — | 240 |
| Dyeing test | | | | | | | | |
| level dyeing | excellent | excellent | excellent | excellent | — | — | — | good |
| dye fixation (A1/A0) | <0.1 | 0.1 to 0.2 | 0.2 to 0.3 | 0.1 to 0.2 | — | — | — | <0.1 |
| Feel | good | good | good | good | — | — | — | good |
| Heat Resistance | good | good | good | good | — | | | |

BEN: 1,1,9,9-bisethylenedioxynonane
a1: castor oil-ethyleneoxide adduct
a2: polyoxyethylene-propylene octyl ether
a3: polyoxyethylene-tristyrlphenyl ether
a4: polyoxyethylene-myristylphenyl ether
a5: polyoxyethylene-higher alcohol ether
b1: ammonium laurylsulfonate
b2: sodium dodecylbenzenesulfonate
b3: sodium polyoxyethylene-lauryl ether sulfate
b4: polyoxyethylene-tristyrylphenol ether sulfate amine salt
c1: ethylene glycol
c2: butyl cellosolve
c3: methanol
c4: isopropyl alcohol
c5: chloroform
c6: propylene carbonate As demonstrated by the data in Table 6 above, the fiber treating compositions of Examples 1 to 4 are all self-emulsifiable, and in those, the compound (I) can be stably emulsified in the bath. In particular, the emulsion stability of the fiber treating compositions of Examples 1, 2 and 4 that contain both a nonionic surfactant and an anionic surfactant along with the compound (I) therein is especially excellent.

As opposed to those, in the fiber treating compositions of Comparative Examples 1 to 3 which contains neither nonionic surfactant nor anionic surfactant but contains the compound (I) only, the compound (I) could not be dissolved or emulsified in the organic solvent or water or even in the mixed solvent of water/organic solvent but formed a separate phase. It is known that effective use of the compositions of those Comparative Examples 1 to 3 is impossible. It is also known that the composition of Comparative Example 4 that comprises the compound (I) and an anionic surfactant greatly foamed at temperatures of 50° C. and higher.

From the data in Table 6, it is further known that the fiber treating compositions of Examples 1, 2 and 4 which contain the compound (I) and both a nonionic surfactant and an anionic surfactant, and the fiber treating composition of Example 3 which contains the compound (I) and a nonionic surfactant foam only a little, and smoothly crosslink fibers, that the fibers as crosslinked with them have good dyeability, that the feel of the crosslinked fibers is good, and that the dye fixation to the crosslinked fibers is also good, in particular, it is known that the fiber treating compositions of Examples 1, 2 and 4 which contain both a nonionic surfactant and an anionic surfactant are especially good, in view of their capabilities to prevent the bath containing them from foaming and thereby to ensure the good dyeability of fibers, the good dye fixation to fibers and the good feel of fibers.

As described in detail hereinabove, the fiber treating composition of the invention that comprises a compound (I) and a nonionic surfactant optionally along with an anionic surfactant is self-emulsifiable, and makes it possible to stably emulsify and disperse the compound (I) in a medium such as an aqueous medium and others all the time from the initial stage of the fiber processing to the final stage thereof. Therefore, fibers as treated with the fiber treating composition of the invention are smoothly crosslinked with the compound (I) in the composition to have much improved heat resistance, steam ironing resistance and dimension resistance while still having the good feel and the good dyeability intrinsic to the original fibers.

In addition, the fiber treating composition of the invention is excellent not only in the emulsion stability but also in the ability to prevent itself from foaming. Therefore, when fabrics are treated with the composition, they are free from the trouble of running failure in the processing bath that may be caused by foaming in the bath, and from the trouble of uneven dyeing, dyeing speed retardation and dye fixation insufficiency that may be also caused by foaming in the bath. With the fiber treating composition of the invention that comprises a compound (I), it is possible to simultaneously and smoothly crosslink and dye fibers in one and the same processing bath, and the productivity in the crosslinking and dyeing process is good.

With the fiber treating composition of the invention, fibers can be well crosslinked in a weakly acidic condition even at high temperatures, and the crosslinking treatment can be finished smoothly in that condition. The fastness and other physical properties of the fibers as treated with the composition are not worsened.

While the invention is described in detail and with reference to specific embodiments thereof, it will be apparent to one skilled in the art that various changes and modifications can be made therein without departing from the spirit and scope thereof.

This application is based on Japanese Patent Application Serial No. 158633/1998, filed on May 25, 1998, and incorporated hereby by reference.

What is claimed is:

1. A fiber treating composition, comprising:

(a) a compound represented by formula (I):

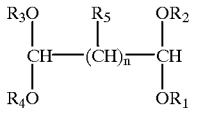

(I)

wherein $R_1$, $R_2$, $R_3$ and $R_4$ each, independently, represent an alkyl group;

or $R_1$ and $R_2$, and $R_3$ and $R_4$, together, form an alkylene group;

$R_5$ represents a hydrogen atom or an alkyl group; and n represents a number of from 2 to 10, (b) a nonionic surfactant, and (c) an anionic surfactant.

2. The fiber treating composition of claim 1, comprising 2 to 20% by weight of the anionic surfactant, based on the total weight of the composition.

3. The fiber treating composition of claim 1, comprising 2 to 30% by weight of the noninonic surfactant, based on the total weight of the composition.

4. The fiber treating composition as claimed in claim 1, wherein the amount of the nonionic surfactant is from 2 to 30 parts by weight relative to 100 parts by weight of the compound of formula (I) and the amount of the of the anionic surfactant is from 2 to 20 parts by weight relative to 100 parts by weight of the compound of formula (I).

5. The fiber treating composition of claim 1, further comprising an organic solvent.

6. The fiber treating composition of claim 5, wherein the organic solvent comprises methyl alcohol, ethyl alcohol, isopropyl alcohol, benzene, xylene, toluene, ethyl acetate, dimethylformamide, petroleum ether, chloroform, ethylene glycol, butyl cellosolve, 1,5-pentanediol, ethylene carbonate, propylene carbonate, propylene glycol, dipropylene glycol, triethylene glycol, triethylene glycol dimethyl ether, pentaethylene glycol monobutyl ether, diethylene glycol monomethyl ether, tetraethylene glycol dimethyl ether, propylene glycol monomethyl ether, or dipropylene glycol monomethyl ether.

7. The fiber treating composition of claim 1, wherein the nonionic surfactant is selected from the group consisting of polyoxyalkylene-alkylphenyl ethers, polyoxyalkylen-etristyrylphenyl ethers, polyoxyalkylene-alkyl ethers, polyoxyalkylene-alkyl esters, castor oil-alkyleneoxide adducts, partial esters of fatty acids with polyalcohols, partial esters of fatty acids with polyoxyalkylene-polyalcohols, esters of fatty acids with polyglycerins, polyoxyalkylene-alkylamines, fatty acid diethanolamides, partial esters of triethanolamine-fatty acids, and mixtures thereof.

8. The fiber treating composition of claim 1, wherein the nonionic surfactant is selected from the group consisting of castor oil-alkyleneoxide adducts, partial esters of fatty acids with polyoxyalkylene-polyalcohols, polyoxyalkylene-tristyrylphenyl ethers, and mixtures thereof.

9. The fiber treating composition of claim 1, wherein the anionic surfactant is selected from the group consisting of alkylsulfates, alkylsulfonates, alkylaryisulfates, alkylarylsulfonates, polyoxyalkylene-alkyl ether sulfates, polyoxyalkylenetristyrylphenyl ether sulfates, polyoxyalkylene-alkyl ether phosphates, polyoxyalkylene-alkyl ether carboxylates, polycarboxylates, Turkey red oil, petroleum sulfonates, polystyrenesulfonates, alkyldiphenyl ether disulfonates, alkyl acid phosphates, and mixtures thereof.

10. The fiber treating composition of claim 1, wherein the anionic surfactant is selected from the group consisting of alkylarylsulfonates, polyoxyalkylenetristyrylphenyl ether sulfates, and mixtures thereof.

11. The fiber treating composition of claim 1, wherein the compound represented by formula (I) is a 1,1,9,9-bisalkylenedioxynonane.

12. The fiber treating composition of claim 1, wherein $R_1$, $R_2$, $R_3$ and $R_4$ each, independently, represent an alkyl group having 1 to 4 carbon atoms;

or $R_1$ and $R_2$, and $R_3$ and $R_4$, together, form an alkylene group having 1 to 4 carbon atoms; and $R_5$ represents a hydrogen atom or an alkyl group having 1 to 4 carbon atoms.

13. The fiber treating composition of claim 1, comprising at least one compound represented by formula (I) in which $R_5$ represents hydrogen and at least one compound represented by formula (I) in which $R_5$ represents an alkyl group.

14. A method of making the fiber treating composition of claim 1, comprising combining (a), (b) and (c).

15. A method of treating fibers, comprising contacting the fibers with the composition of claim 1.

16. A method of crosslinking fibers, comprising contacting the fibers with the composition of claim 1.

* * * * *